US005424629A

United States Patent [19]

Fujiwara et al.

[11] Patent Number: 5,424,629

[45] Date of Patent: Jun. 13, 1995

[54] POWER CIRCUIT FOR A SEMICONDUCTOR APPARATUS

[75] Inventors: Atsushi Fujiwara, Kadoma; Akinori Shibayama, Neyagawa, both of Japan

[73] Assignee: Matsushita Electric Industrial Co., Ltd., Osaka, Japan

[21] Appl. No.: 865,363

[22] Filed: Apr. 8, 1992

[30] Foreign Application Priority Data

Apr. 11, 1991 [JP] Japan ..... 3-078882
Jul. 18, 1991 [JP] Japan ..... 3-178079

[51] Int. Cl.[6] ..... G05F 5/08
[52] U.S. Cl. ..... 323/349; 323/303; 327/538
[58] Field of Search ..... 323/299, 303, 318, 349; 307/296.6

[56] References Cited

U.S. PATENT DOCUMENTS 4,859,871 8/1989 Kobayashi et al. ..... 307/264

FOREIGN PATENT DOCUMENTS 63-244217 10/1988 Japan .
2-197163 8/1990 Japan .

*Primary Examiner*—Steven L. Stephan
*Assistant Examiner*—Adolf Berhane
*Attorney, Agent, or Firm*—Ratner & Prestia

[57] ABSTRACT

A power circuit for a semiconductor apparatus comprising an internal power voltage generating circuit generating an internal power voltage, an external power voltage detecting circuit, a power voltage switching circuit switching the internal power voltage to the external power voltage in response to the output of the external power voltage detecting circuit, and a switching signal setting circuit. The output of the power voltage switching circuit is the internal power voltage when power is first applied to the semiconductor device. The switching signal setting circuit provides the correct power voltage switching signals quickly to the power voltage switching circuit when power is applied and the external power voltage is not inputted to the apparatus at the early stage of power application.

8 Claims, 9 Drawing Sheets

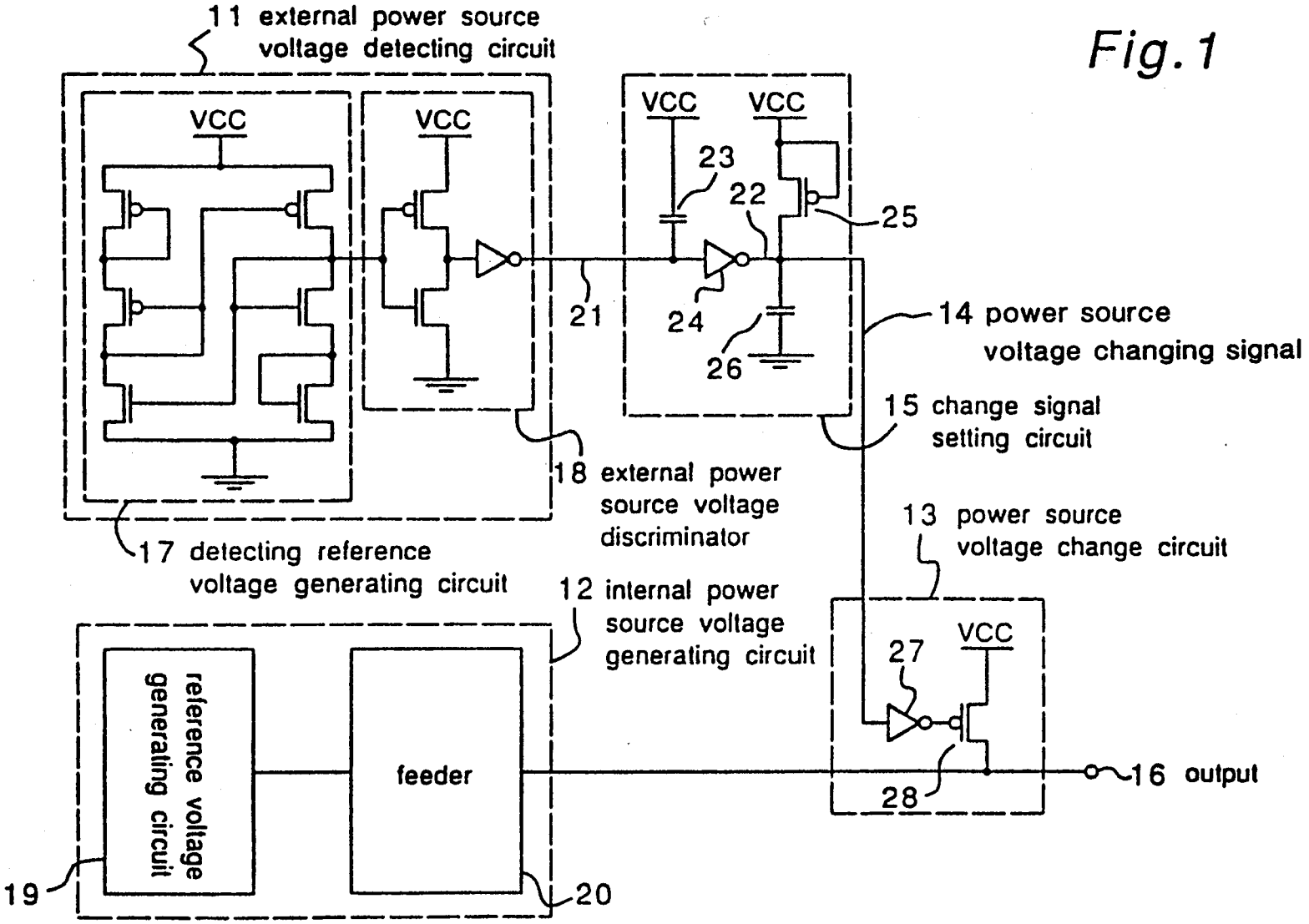
Fig. 1
11 external power source voltage detecting circuit
17 detecting reference voltage generating circuit
18 external power source voltage discriminator
12 internal power source voltage generating circuit
13 power source voltage change circuit
14 power source voltage changing signal
15 change signal setting circuit
16 output
VCC
21
22
23
24
25
26
27
28
20
feeder
reference voltage generating circuit
19 a) external power source voltage
b) internal power source voltage
c) signal 21
d) signal 22
e) power source voltage changing signal 14
f) output 16
→time 11 external power source voltage detecting circuit
17 detecting reference voltage generating circuit
18 external power source voltage discriminator
12 internal power source voltage generating circuit
20
feeder
16 output
13 power source voltage change circuit
14 power source voltage changing signal
15 change signal setting circuit
VCC
21
22
23
24
25
26
27
28

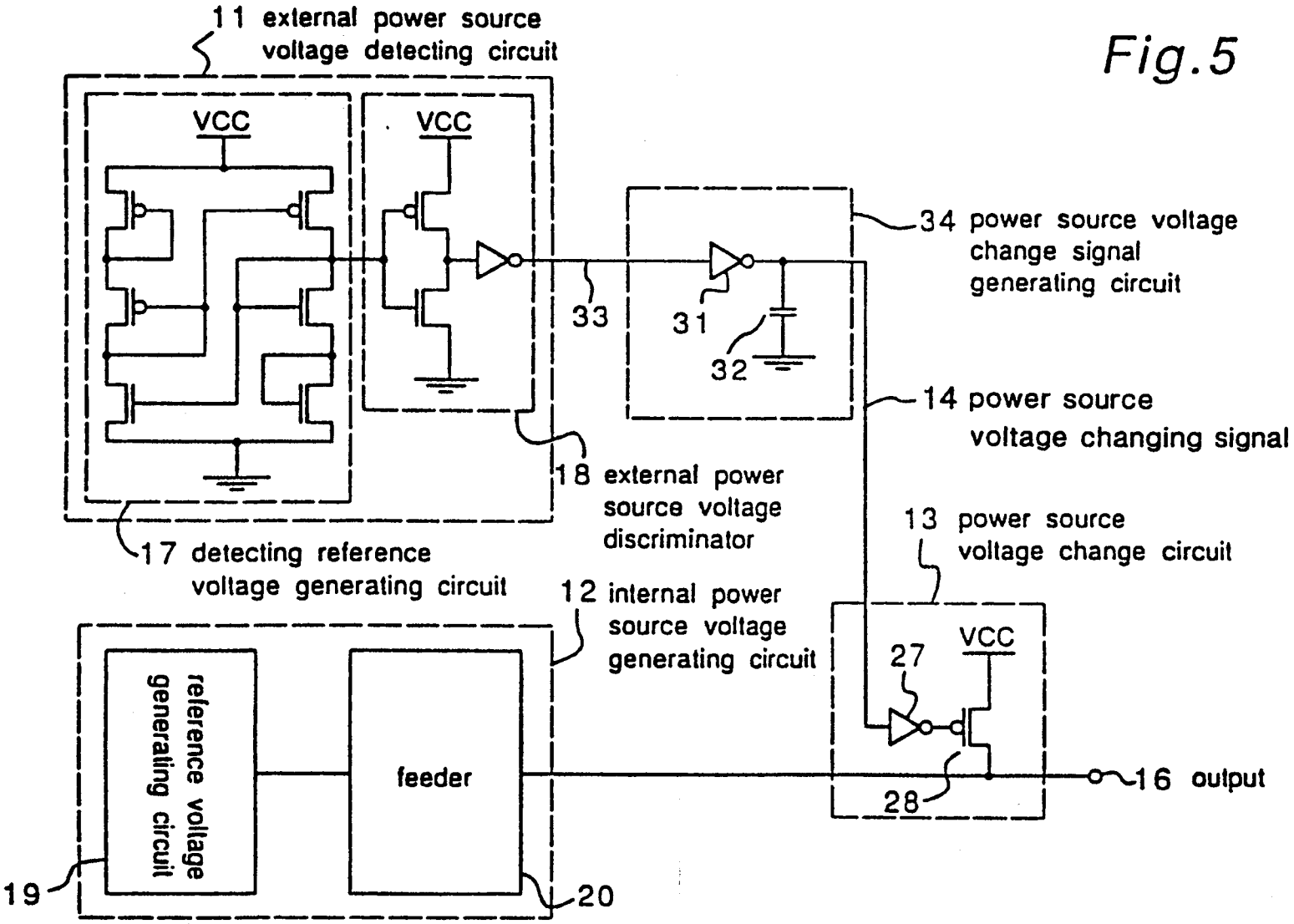
Fig.5
34 power source voltage change signal generating circuit
14 power source voltage changing signal
13 power source voltage change circuit
16 output
VCC
27
28
31
32
33
18 external power source voltage discriminator
12 internal power source voltage generating circuit
20
11 external power source voltage detecting circuit
VCC
VCC
17 detecting reference voltage generating circuit
feeder
reference voltage generating circuit
19

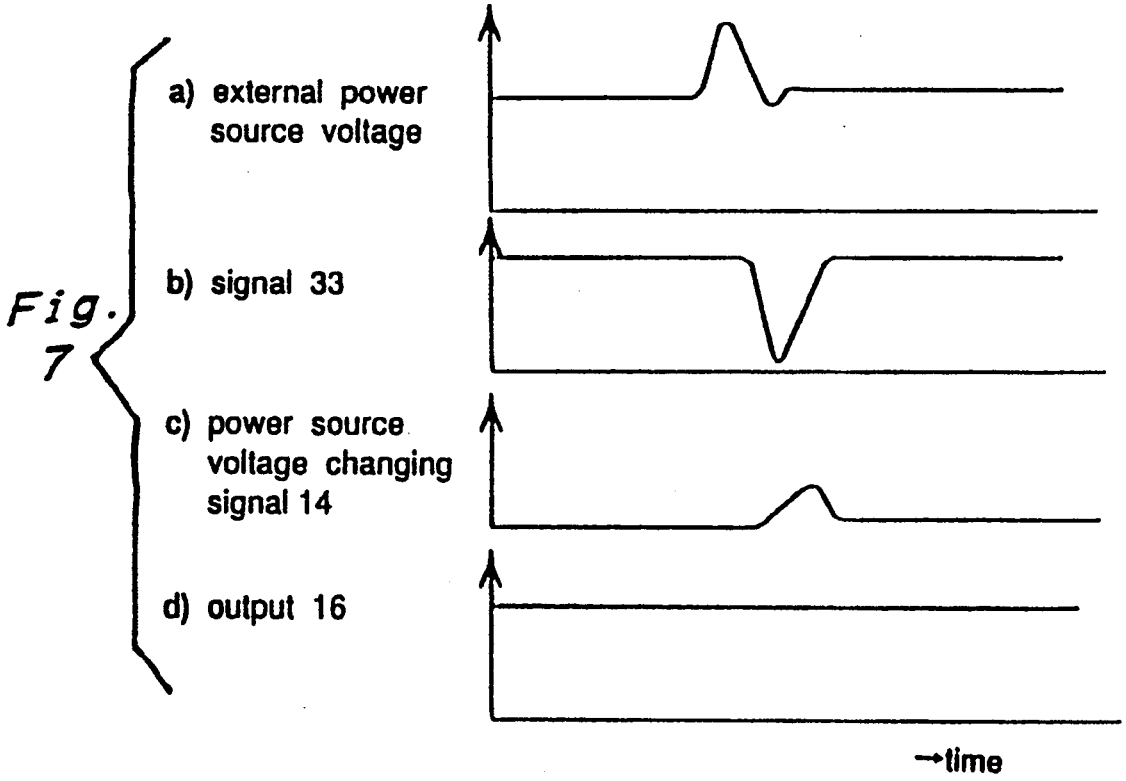
Fig.8
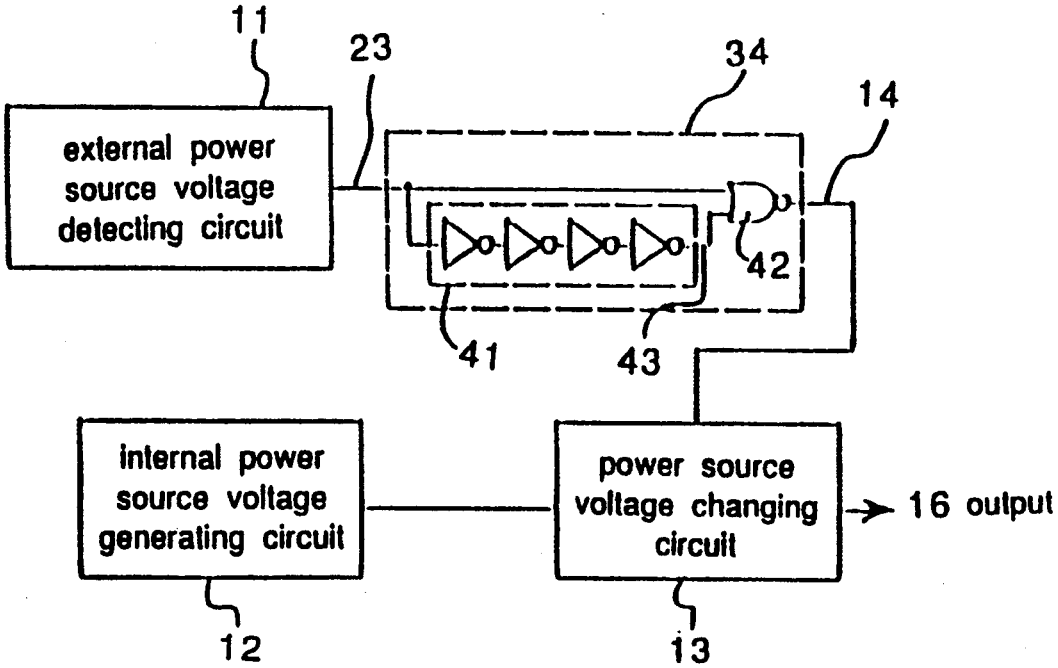

a) external power source voltage
b) signal 33
c) output of deleaying 43
d) power source voltage changing signal 14
e) output 16
→time

POWER CIRCUIT FOR A SEMICONDUCTOR APPARATUS

BACKGROUND OF THE INVENTION

The present invention generally relates to a semiconductor apparatus, and more particularly, to a circuit provided with an internal power generating means within the semiconductor so as to switch the internal power voltage from the outside when an acceleration test or the like is effected.

The power voltage of CMOS LSI is desired to be 5 V unit as TTL is a power voltage 5 V. But the minuteness of the LSI is desired to be advanced and also, the power voltage is also desired to be scaled in terms of reliability and so on. As one of the solving methods of the above described problems, a system where an internal voltage generating circuit is provided in the LSI with an external voltage being 5 V, the operation is effected with the internal voltage being 3 V.

When acceleration tests by high power voltages such as burn-in tests are tried with respect to the semiconductor apparatus using the system, an acceleration test cannot be effected, because the power voltage is not increased as expected, if the external voltage voltage is made higher within, due to an internal power voltage generating circuit. Therefore, a power circuit with such an external power voltage detecting circuit attached to it as the internal power voltage is switched into an external power voltage from the output of the inner power voltage generating circuit when the external power voltage becomes a certain voltage or more in a burn-in test or the like.

FIG. 10 is a block diagram of an conventional internal power circuit with an external power voltage detecting circuit. Referring now to FIG. 10, reference numeral 1 is an external power voltage detecting circuit, reference numeral 2 is an internal power voltage generating circuit, reference numeral 3 is a power voltage switching circuit, reference numeral 4 is a power voltage switching signal, reference numeral 6 is an output of a power circuit.

An operation of the conventional power circuit constructed as described hereinafter will be described.

When the external power voltage VCC stays within the normal operation voltage range of the semiconductor apparatus, the external power voltage detecting circuit 1 outputs a "L" level (low voltage level) as a power voltage switching signal 4. Voltages generated from the internal power voltage generating circuit 2 are outputted to the output 6 by a power voltage switching circuit 3. When the external power voltage VCC has become a voltage of the normal operation power voltage or more in the burn-in tests or the like, the external power voltage detecting circuit 1 outputs a "H" level (high voltage level) as a power voltage switching signal 4 so as to connect the external power VCC to the output 6 by a power voltage switching circuit 3.

In such conventional construction as described hereinabove, it takes much time until a correct power voltage switching signal 4 is outputted when the external power voltage detecting circuit 1 puts the power supply to work. As shown in FIG. 11, the power voltage switching signal 4 rises together with the rise of the VCC, and the correct output of the external power voltage detecting circuit 1 is effected after a while. The power voltage switching circuit 3 has a disadvantage of outputting the external power voltage at the early stage of the power supply to be put to work. When the external power voltage is outputted at the power transfer, there is a problem that the reliability of the semiconductor apparatus is deteriorated.

SUMMARY OF THE INVENTION

Accordingly, an essential object of the present invention is to provide an improved semiconductor apparatus of feeding a correct internal power voltage to an apparatus even at a power supply application time in a semiconductor apparatus for automatically effecting, by the height of the external power voltage, the switching operation of the internal power voltage at a burn-in test or the like.

Another important object of the present invention is to provide a semiconductor apparatus which is superior in noise-proof property, wherein the power voltage cannot be switched by mistake into the external power supply voltage if the noises of high voltage enter the external power voltage during the use in the normal operation voltage range.

Still another object of the present invention is to provide a semiconductor apparatus wherein the threshold values of the power voltage for switching the internal power voltage are hard to be affected by the dispersion of the process parameters, in a semiconductor apparatus for automatically effecting, by the height of the external power voltage, the switching operation of the internal power voltage in a burn-in test or the like.

The semiconductor apparatus of the present invention comprises an internal power voltage generating means for generating the internal power voltages, an external power voltage detecting circuit, a power voltage switching means for switching the internal power voltage to the external power voltage by the output of the external power voltage switching means, a switching signal setting means for setting the power voltage switching signal so that the output of the power voltage switching means may become the above described internal power supply at the power application.

As the switching signal setting means sets to a correct signal the power voltage switching signal quickly at the power application by the above described construction, the present invention can realize a semiconductor apparatus where the external power voltage cannot input to the apparatus at the earlier stage of the power application.

A semiconductor apparatus of the present invention comprises an internal power voltage generating means for generating an internal power voltage, an external power voltage detecting means for outputting an external power voltage detecting signal when an external power voltage becomes a given voltage or more, a power voltage switching signal generating means for outputting a power voltage switching signal when the external power voltage detecting signals continue to be inputted for a set time or more, a power voltage switching means for switching the above described internal power voltage to the above described external power voltage with the above described power voltage switching signal.

The present invention can realize a semiconductor apparatus superior in noise-proof property, where the power voltage cannot be switched by mistake to the external power voltage if noises of the high voltage enter the external power voltage during the use in the normal operation voltage range by the above described construction.

The semiconductor of the present invention comprises an internal power voltage generating means for generating an internal power voltage, a detecting reference voltage generating means for generating the reference voltage which is less in dependence with respect to the external power voltage, an external power voltage detecting circuit, to which the above described reference voltage is inputted, for detecting the voltage level of the reference voltage, a power voltage switching means for switching the above described internal power voltage to the above described external power voltage by the output of the above described external power voltage detecting circuit.

By the above described construction of the present invention, the reference voltage for detecting the external power voltage is approximately constant without depending upon the external power voltage. Only the threshold value of the external power voltage detecting circuit rises together with the rise of the external power voltage. The switching operation of the internal voltage is effected when the reference voltage has become a threshold value or lower. The difference between the reference voltage and the threshold is large in change. The present invention is not subjected under the influences of the dispersion of the process parameters such as the threshold values of the transistors, so that the setting of the power voltage for switching the internal power voltage can be also effected correctly and easily.

BRIEF DESCRIPTION OF THE DRAWINGS

These and other objects and features of the present invention will become apparent from the following description taken in conjunction with the preferred embodiment thereof with reference to the accompanying drawings, in which;

FIG. 1 is a block diagram of a semiconductor apparatus in a first embodiment of the present invention;

FIG. 5 is a block diagram of a semiconductor apparatus in a third embodiment of the present invention;

FIG. 7 shows charts for illustrating the operations of a semiconductor apparatus in the third embodiment of the present invention;

FIG. 8 is a block diagram of a semiconductor apparatus in a fourth embodiment of the present invention;

DETAILED DESCRIPTION OF THE INVENTION

Figure 2:
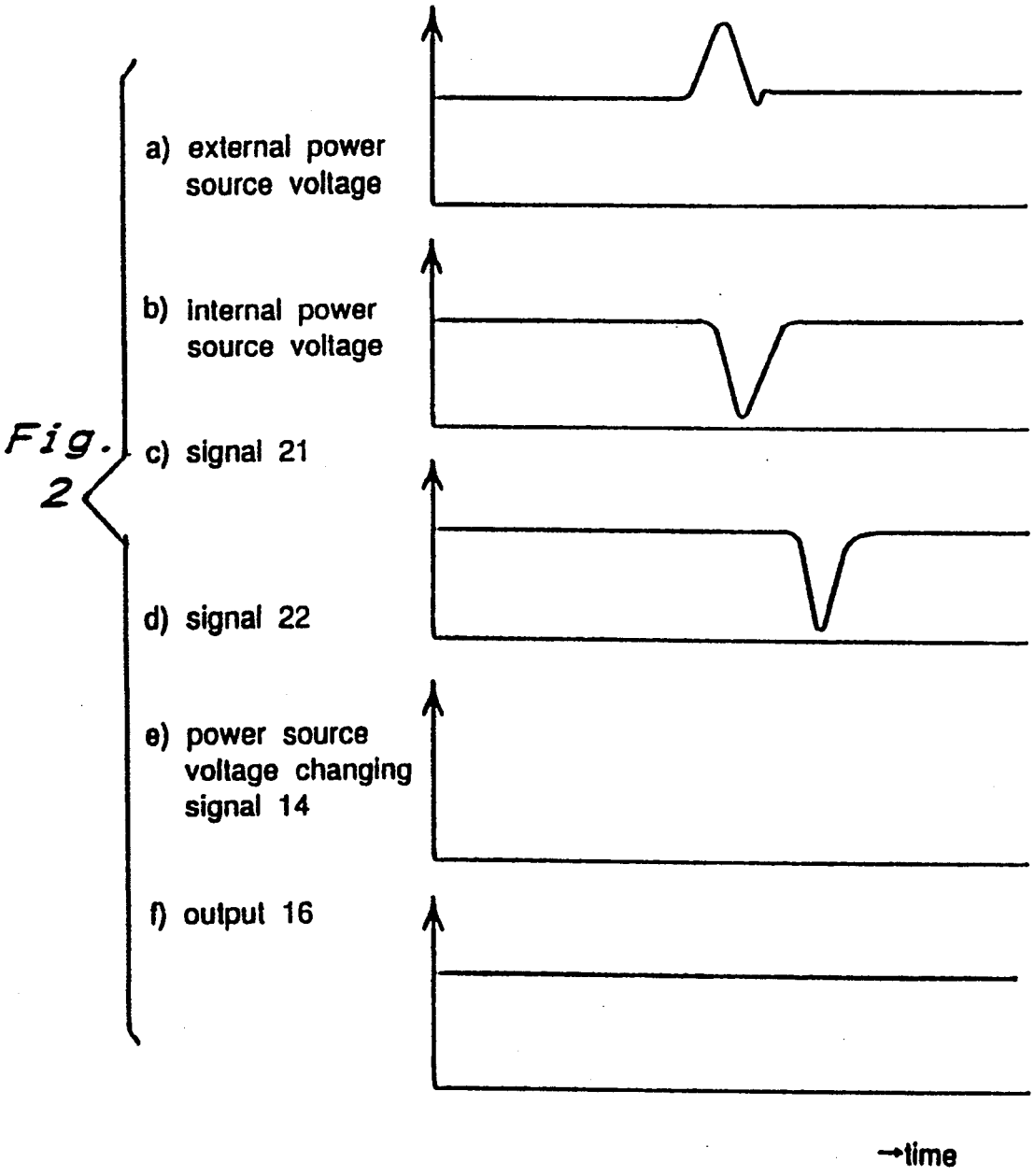
FIG. 2 shows charts for illustrating the operations of a semiconductor apparatus in the first embodiment of the present invention.

Before the description of the present invention proceeds, it is to be noted that like parts are designated by like reference numerals throughout the accompanying drawings.

The semiconductor apparatus in four embodiments of the present invention will be described hereinafter with reference to the drawings.

First Embodiment

FIG. 1 is a block diagram of a power circuit of a semiconductor apparatus in a first embodiment of the present invention. In FIG. 1, reference numeral 11 is an external power voltage detecting circuit, reference numeral 12 is an internal power voltage generating circuit, reference numeral 13 is a power voltage switching circuit, reference numeral 15 is a switching signal setting circuit.

The internal power voltage generating circuit 12 includes a reference voltage generating circuit 19 and a feeder 20.

The power voltage switching circuit 13 is composed of an inverter 27 with a power voltage switching signal 14 being connected to an input, a p type MOS transistor 28 with the output of the inverter 27 being connected to a gate, the external power supply being connected to a source. A switching signal setting circuit 15 is composed of capacitor 23 provided between the output signal 21 of the external power voltage detecting circuit 11 and the external power voltage, an inverter 24 with the output of the external voltage detecting circuit 11 being connected to an input, capacitor 26 provided between the output of the inverter 24 and the ground power supply, a p type MOS transistor 25 with the output of the inverter 24 being connected to a drain, and the external power supply being connected to a source and a gate.

The semiconductor apparatus constructed as described hereinabove will be described in its operation with the use of FIG. 1 and FIG. 2. FIG. 2 shows charts for illustrating the operations in a first embodiment.

Before the power supply is put to work, the signal 21 is uncertain. As the p type transistor 25 with the gate being connected to an external power supply as shown in FIG. 1 is provided between the power voltages, the signal 22 does not become a threshold value voltage Vt or more of the p type transistor 25 or more. If the signal 22 tries to become an electric potential of Vt or more, the current flows through the p type transistor 25 to an external power supply from the signal 22, so that the signal 22 falls down to Vt.

When the power supply begins working, the signal 21 rises in the electric potential, together with the rise of the power voltage by the capacitance coupling as the capacitor 23 is formed between the power wires. As the capacitor 26 is formed between the ground electric potentials, the signal 22 is hard to change without the rise in the power voltage, tries to maintain the voltage before the power application. The signal 21 exceeds the threshold value voltage of the inverter 24. The signal 22 is stably set at a low voltage level by the output of the inverter 24. If the correct output of the external power voltage detecting circuit 11 is delayed, the power voltage switching signal 14 is correctly set, without a problem that the external power voltage is outputted temporarily to the output 16 at the power application.

In the first embodiment, the internal power voltage generating means 12 for generating the internal power voltage, external power voltage detecting circuit 11, power voltage switching means 13 for switching the internal power voltage into the external power voltage by the output of the external power voltage detecting circuit 11, switching signal setting means 15 for setting the power voltage switching signal so that the output of the power voltage switching means 13 may become the internal power at the power application time are provided to realize a semiconductor apparatus where the external power voltage is not applied to the apparatus even if the output of the external power voltage detecting circuit 11 is delayed at the power application time.

The semiconductor apparatus constructed as described hereinabove will be described in the operation of the external power voltage detecting circuit 11 with reference to FIG. 2 and FIG. 3.

When the external power voltage VCC is within the normal operating voltage range of the semiconductor apparatus, the external power voltage detection circuit 11 outputs the "H" level (high voltage level). The voltage generated from the internal power voltage generating circuit 12 is outputted to the output 16 by the power voltage switching circuit 13. When the external power voltage VCC has become a voltage of the normal power voltage or more in cases where the burn-in tests are performed, the external power voltage detecting circuit 11 outputs the "L" level (low voltage level) to connect the external power VCC to the output 16 with the power voltage switching circuit 13.

The operation of the external power voltage detecting circuit 11 will be described in detail.

The detecting reference voltage generating circuit 17 generates a stable reference voltage which is less in dependence with respect to the external power voltage. In the embodiment shown in FIG. 3, the reference voltage is set to approximately 3 V or so. As the threshold voltage Vt where the "H" level and "L" level of the output of the detector 11 are switched can be called an input voltage where the saturation current of the p type MOS transistor becomes equal to a saturated current of the n type MOS transistor, it is determined by the following formula (1).

$$k1(Vt-Vt1)^2 \simeq k2\,(Vt-Vcc-Vt2)^2 \quad (1)$$

In the formula (1), Vt1 is a threshold value voltage of the n type transistor, Vt2 is a threshold value voltage of the p type transistor. The threshold value Vt is determined by the following formula (2).

$$Vt \simeq \frac{Vcc - Vt1 + Vt2}{\frac{k1}{k2} + 1} + Vt1 \quad (2)$$

Figure 3:
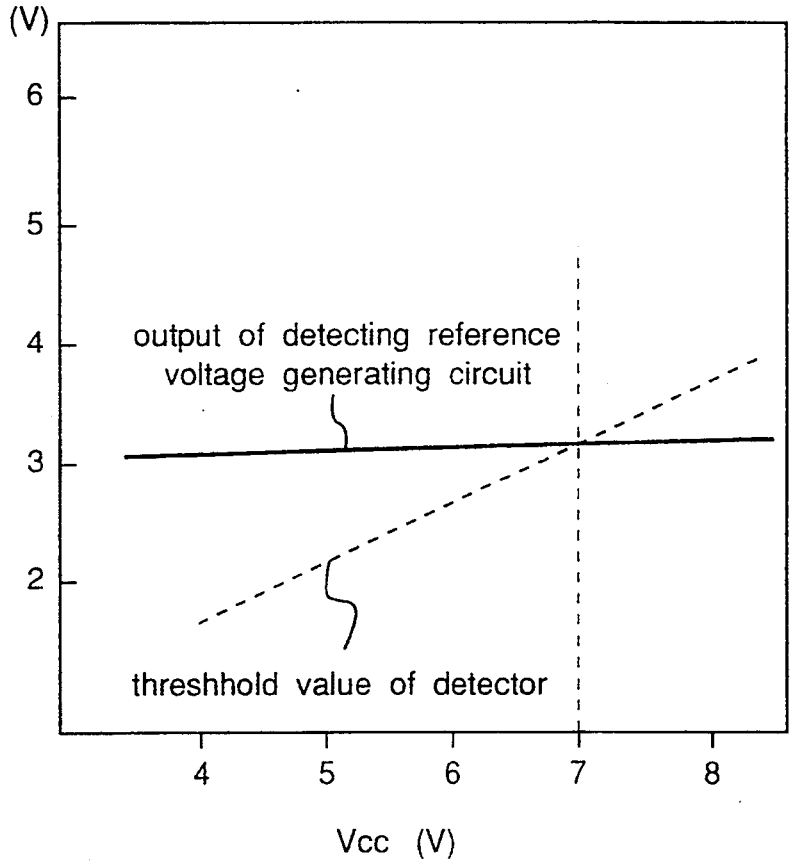
FIG. 3 shows a graph for illustrating the operation of an external power voltage detecting circuit in the same embodiment.

Therefore, the threshold value voltage Vt of a detector 11 increases as the VCC increases as shown in FIG. 3. In the example shown in FIG. 3, the output of the detecting reference voltage generating circuit 17 in the range where the VCC is 7 V or lower is higher than a threshold value of the detector 11, so that the output of the external power voltage detecting circuit 11 becomes the "H" level. When the VCC becomes 7 V or more, the output of the detecting reference voltage circuit 17 reversibly becomes lower than the threshold value of the detector 11, so that the output of the external power voltage detecting circuit is switched to the "L" level.

As is clear from FIG. 2, although the threshold value of the detector 11 rises with the rise of the VCC, the detecting reference voltage is approximately certain independently of the external power voltage. Change in the difference from the threshold value of the detector 11 by the VCC is large. It is hard to be affected by the dispersion of the process parameter such as the threshold value of the transistor.

In this embodiment, the internal power voltage generating means 12 for generating the internal power voltage, detecting reference voltage generating means 17 for generating a reference voltage which is less in dependence with respect to the external power voltage, an external power voltage detecting circuit 11, to which the reference voltage is gate-inputted, for detecting the voltage level of the reference voltage, a power voltage switching means 13 for switching the internal power voltage to the external power voltage by the output of the external power voltage detecting circuit 11 are provided. Influences of the dispersion of the process parameters such as threshold values of the transistor are hard to be affected. The setting of the power voltage for switching the internal power voltage can also be effected correctly and easily.

In addition, the power circuit composed of a reference voltage generating circuit 19 for generating the reference voltage and the supplier 20 for generating the internal power voltage in accordance with the reference voltage is shown as an internal power voltage generating circuit 12. It may be made a step-down circuit or the like by resistance division.

Second Embodiment

A second embodiment of the present invention will be described with reference to FIG. 4.

Figure 4:
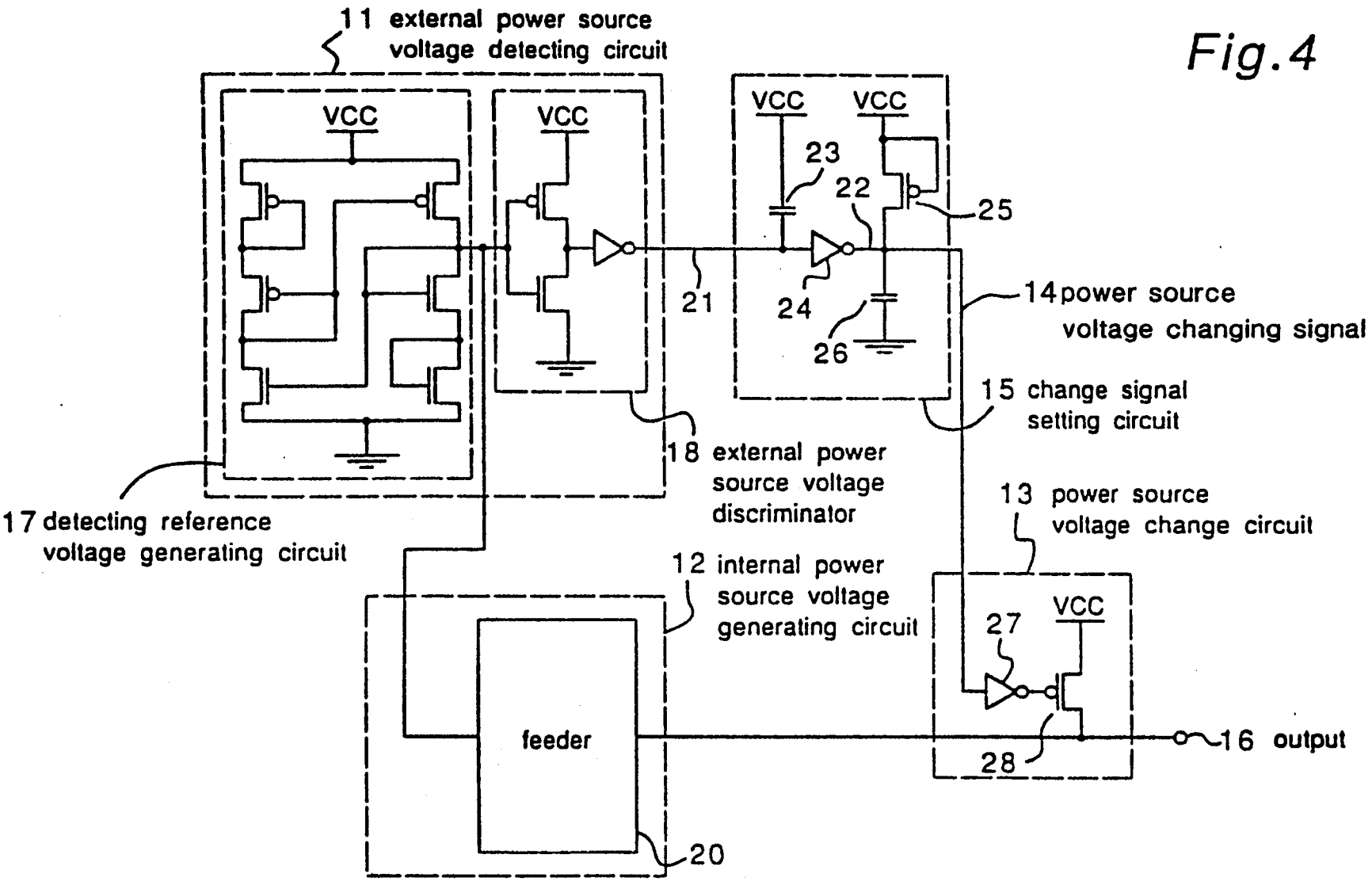
FIG. 4 is a block diagram of a semiconductor apparatus in a second embodiment of the present invention.

FIG. 4 is a block diagram of a power circuit of a semiconductor apparatus showing a second embodiment of the present invention.

In FIG. 4, reference numeral 17 is a reference voltage generating circuit, reference numeral 20 is a supplier for generating an internal voltage in accordance with the reference voltage generated by the reference voltage generating circuit 17, reference numeral 11 is an external power voltage detecting circuit, reference numeral 13 is a power voltage switching circuit for switching the external power voltage to the internal power voltage by the output of the external power voltage detecting circuit 11, which are similar to the construction of FIG. 1.

The difference from FIG. 1 is that the output of the reference voltage generating circuit 17 for generating the reference voltage for the external power voltage detecting circuit 12 is used, instead of the output of the reference voltage generating circuit 19 for the internal power voltage generating circuit 12 as the reference voltage for the internal power voltage generating use. The operation is omitted in description, as it is similar in operation to the first embodiment. As described hereinabove, by the use of the reference voltage for the external power voltage detecting circuit as the reference voltage for the internal power voltage generating circuit in the second embodiment, the area of the internal power voltage generating circuit 12 can be reduced as compared with the first embodiment. Needless to say, the effect similar to that shown in the first embodiment is provided.

As is clear from the arrangement of the second embodiment, the internal power voltage generating means for generating an internal power voltage, detecting reference voltage generating means for generating the reference voltage less in dependence with respect to the external power voltage, external power voltage detecting circuit, to which the reference voltage is inputted, for detecting the voltage level of the reference voltage, power voltage switching means for switching the internal power voltage into the external power voltage by the output of the external power voltage detecting circuit are provided. The influences of the dispersion of the process parameters such as threshold values of the transistors are hard to be affected. The setting of the power voltage for switching the internal voltage is also effected correctly and easily.

Third Embodiment

Figure 6:
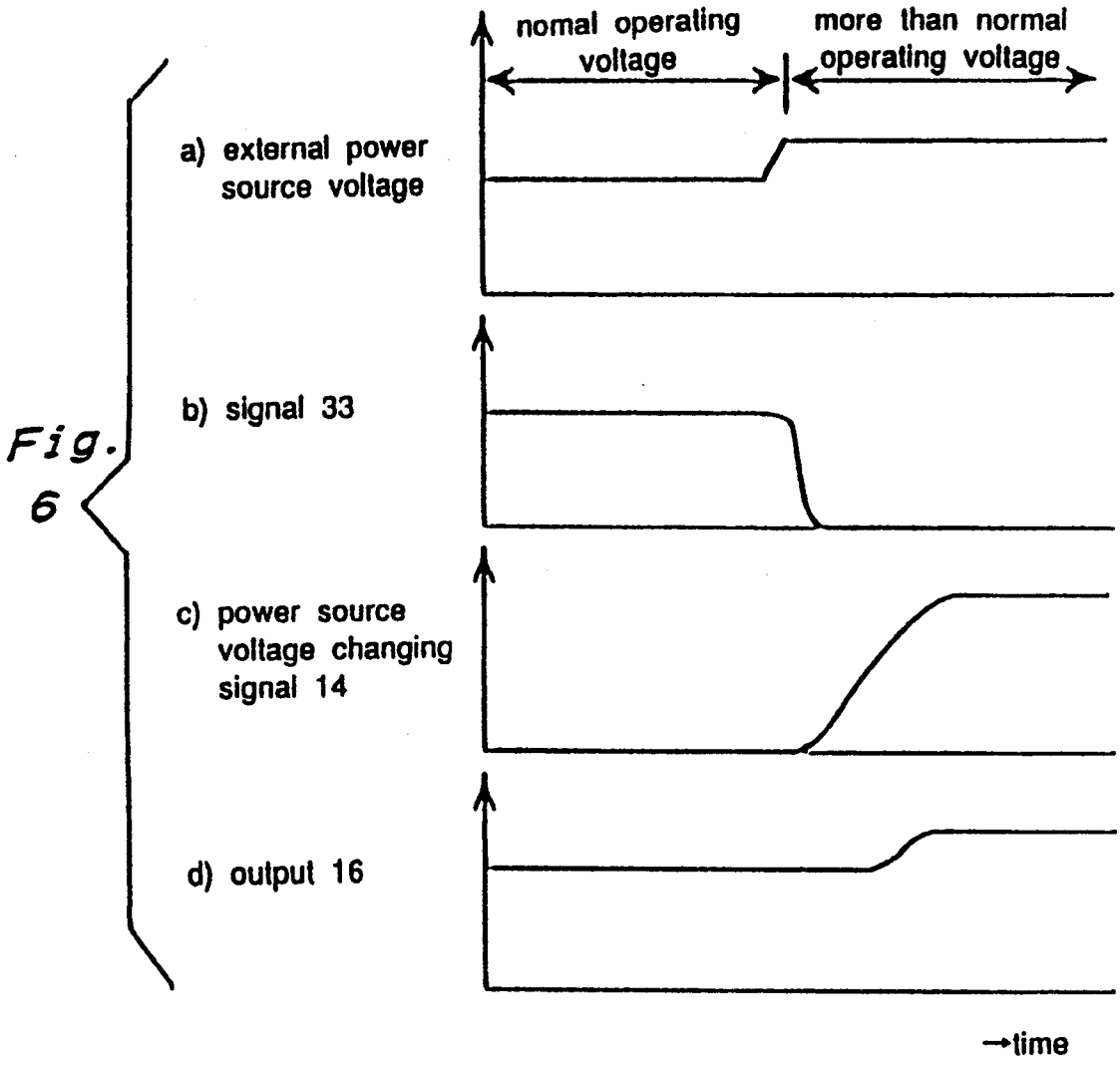
FIG. 6 shows charts for illustrating the operations of a semiconductor apparatus in the third embodiment of the present invention.

FIG. 5 is a block diagram of a power circuit of a semiconductor apparatus according to the third embodiment of the present invention. FIG. 6 and FIG. 7 are charts for illustrating the operations in the same embodiment. In FIG. 5, reference numeral 11 is an external power voltage detecting circuit, reference numeral 12 is an internal power voltage generating circuit, reference numeral 13 is a power voltage switching circuit, reference numeral 34 is a power voltage switching signal generating circuit. The power voltage switching signal generating circuit 34 is composed of a CMOS type inverter 31 and capacitor 32. In CMOS inverter 31, a mutual conductance of a p type transistor is set smaller than a mutual conductance of a n type transistor.

The operation of the third embodiment of the present invention will be described hereinafter with the use of FIG. 5, FIG. 6, and FIG. 7.

When the external power voltage is in the normal operation voltage range of the semiconductor apparatus, as shown in FIG. 6, an external power voltage detecting circuit 11 outputs an "H" level (high voltage level), power voltage switching signal 14 becomes an "L" level (low voltage level), a voltage generated by the internal power voltage generating circuit 12 is outputted to the output 16 by a power voltage switching circuit 13. The output of the external power voltage detecting circuit 11 outputs is an "L" level when the external power voltage is composed of a normal operating voltage or more in the burn-in test or the like. Then the external power voltage is outputted to the output 16 by the power voltage switching circuit 13.

A case will be described where the voltage of a normal operating voltage or more has been applied as noises for a short time during the operation in the normal operating voltage range. FIG. 7 shows an operation illustrating chart in the case. When the external power voltage exceeds a certain voltage, the signal 33 lowers as shown in FIG. 7. Thus, the power voltage switching signal 14 tries to rise. In the CMOS inverter 31, the p type MOS transistor is set to become smaller in the mutual inductance than the n type MOS transistor. The output is slower in the rising speed and is faster in falling speed. The power voltage switching signal 14 takes much time to reach the "H" level from the "L" level. The time can be set by the ratio of the mutual inductance of the p type MOS transistor and the n type MOS transistor, and the size of the capacitor 32. When the noise of the external power voltage is shorter than the set time, the power voltage switching signal 14 returns again to the "L" level before reaching the "H" level from the "L" level. Therefore, the switching operation of the power voltage is not affected, the output voltage of the internal power voltage continues to be outputted from the output 16.

In the first embodiment of FIG. 1, the COMS type inverter is used as the inverter 24. The mutual conductance of the n type MOS transistor is made larger than the mutual conductance of the p type MOS transistor constituting the above described CMOS type inverter, so that the similar effect can be obtained.

According to the present embodiment, an internal power voltage generating means 12 for generating an internal power voltage, an external power voltage detecting circuit 11, a CMOS type inverter 31 for connecting the output of the external power voltage detecting circuit to the input so as to output the power voltage switching signal 14, a power voltage switching signal generating means 34 composed of the above described CMOS type inverter 31 and the capacitor 32 set between the ground power voltages, a power voltage switching means 13 for switching the internal power voltage into the external power voltage by the output of the power voltage switching signal generating means 34, so that the mutual conductance of the n type MOS transistor of the CMOS type inverter for constituting the power voltage switching signal generating means 34 is made larger than the mutual conductance of the p type MOS transistor constituting the above described CMOS so as to realize a semiconductor apparatus where the power supply voltage switching circuit 13 does not output the external power voltage if noises of the high voltage are generated for a short time in the external power voltage.

Fourth Embodiment

Figure 9:
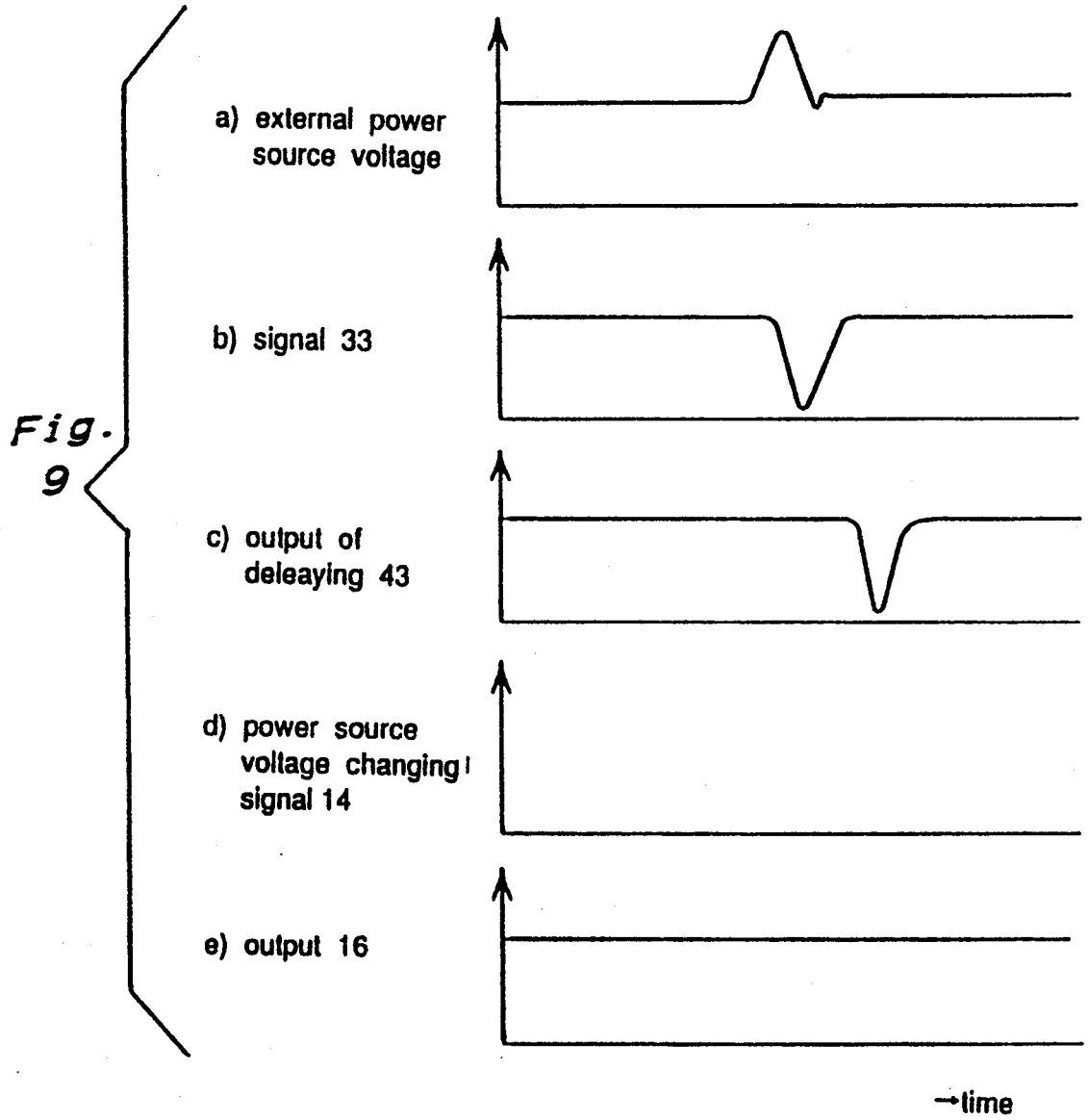
FIG. 9 shows charts for illustrating the operations of a semiconductor apparatus in a fourth embodiment of the present invention.
Figure 10:
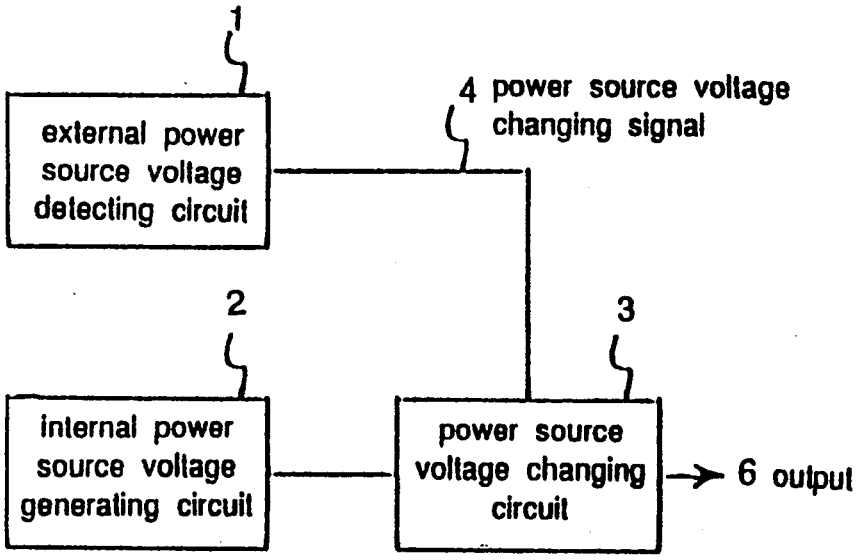
Fig.10 PRIOR ART
FIG. 10 is a block diagram of a power circuit in the conventional semiconductor apparatus.
Figure 11:
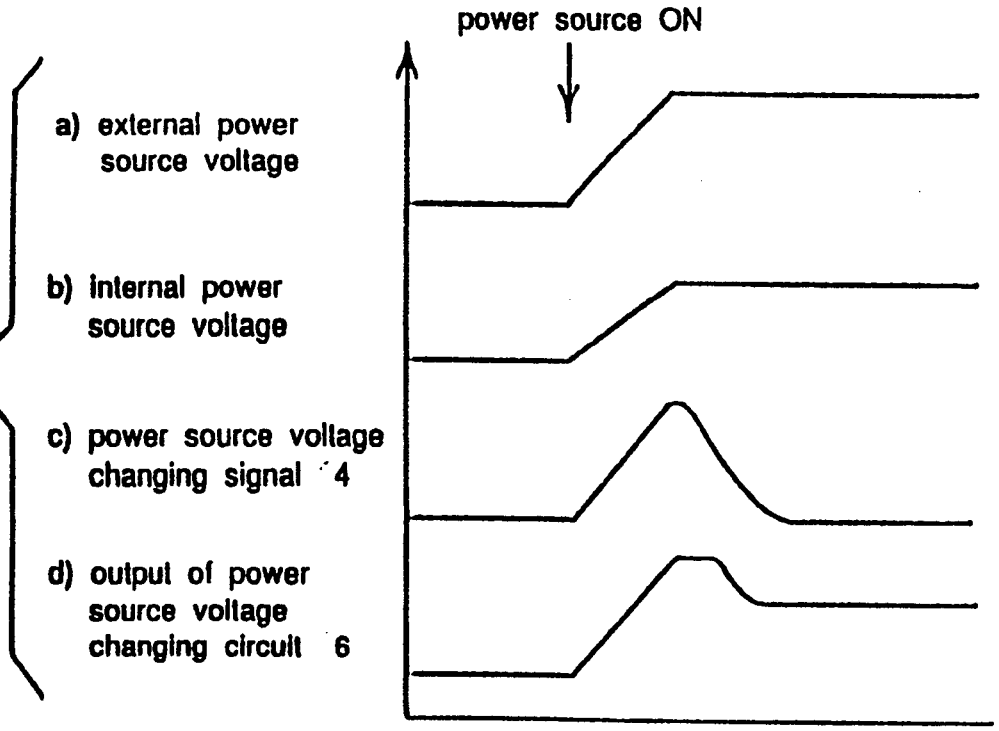
Fig. 11 PRIOR ART
FIG. 11 shows charts for illustrating the operations at the power application time of the power circuit in the conventional semiconductor apparatus.

FIG. 8 is a block diagram of a power circuit of the semiconductor apparatus according to a fourth embodiment of the present invention. FIG. 9 shows charts illustrating the operations in the same embodiment. In FIG. 8, reference numeral 11 is an external power voltage detecting circuit, reference numeral 12 is an internal power voltage generating circuit, reference numeral 13 is a power voltage switching circuit, and reference numeral 34 is a power voltage switching signal generating circuit. The power voltage switching signal generating circuit 34 is composed of a delayer 41 and a NOR circuit 42.

The operation of the third embodiment of the present invention will be described hereinafter with the use of FIG. 8 and FIG. 9.

The operations in cases where the external power voltage is in the normal operation voltage range of the semiconductor apparatus and the external power voltage is composed of a normal operation voltage or more in a burn-in test or the like are omitted as they are similar to those in the third embodiment. Only a case where the normal operation voltage or more as noises has been applied for a short time during the operation of the normal operation voltage range will be described. FIG. 9 shows the operation illustrating charts in the case.

When the exceeds power voltage extends a certain voltage, the signal 33 falls as shown in FIG. 9. As the other input 43 of the NOR circuit 42 is at the "H" level, the power voltage switching signal 14 which is the output of the NOR circuit remains at the "L" level. Thereafter, although the output 43 of the delayer becomes the "L" level after the lapse of the delay time of the delayer, the power delay switching signal 14 still remains at the "L" level as the signal 33 already becomes the "H" level. If the width of the noise of the external power voltage is shorter than the delay time of the delayer 41, the power voltage switching signal 14 remains at the "L" and the output of the internal power voltage generating circuit 12 is continuously outputted to the output 16.

According to the fourth embodiment, an internal power voltage generating means 12 for generating the internal power voltage, an external power voltage detecting circuit 11, a delayer 41 for inputting the output of the external power voltage detecting circuit 11, a NOR circuit 42 for outputting as a power voltage switching signal 14 the NOR logic of the output of the delayer and the output of the external power voltage detecting circuit, a power voltage switching means 13 for switching the external power voltage into the internal power voltage by the power voltage switching signal 14 are provided so that a semiconductor apparatus can be realized where the power voltage switching circuit does not output the external power voltage even if the noises of the high voltage are caused for a short time in the external power voltage.

As is clear from the foregoing description, the present invention is composed of an internal power voltage generating means for generating an internal power voltage, an external power voltage detecting circuit, a power voltage switching means for switching the internal power voltage to the external power voltage by the output of the external power voltage detecting circuit, and a switching signal setting means for setting the power voltage switching signal so that the output of the power voltage switching means may become the internal power supply at the power application. The switching setting signal setting means sets the power voltage switching signal into a correct signal fast, and the external power voltage is not inputted to the apparatus at the early stage of the power application. The present invention is composed of an internal power voltage generating means for generating an internal power voltage, an external power voltage detecting circuit for outputting the external power voltage detecting signal when the external power voltage becomes a given voltage or more, a power voltage switching signal generating means for outputting a power voltage switching signal when the external power voltage detecting signal is continuously inputted for a set time or more, a power voltage switching means for switching the above described internal power voltage to the above described external power voltage by the above described power voltage switching signal so as to realize a semiconductor apparatus superior in the noise-proof property where the power voltage is not switched into the external power voltage by mistake if the noises of the high voltage enter the external power voltage during the use in the normal operating voltage range.

Although the present invention has been fully described by way of example with reference to the accompanying drawings, it is to be noted here that various changes and modifications will be apparent to those skilled in the art. Therefore, unless such changes and modifications depart form the scope of the present invention, they should be construed as included therein.

What is claimed is:

1. A power circuit for a semiconductor apparatus subject to an external power voltage, said power circuit comprising:

an internal power voltage generating circuit generating an internal power voltage;

an external power voltage detecting circuit providing an output which becomes power voltage switching signals when said external power voltage reaches a threshold voltage;

a power voltage switching circuit switching the internal power voltage to the external power voltage in response to the power voltage switching signals; and a switching signal setting circuit disposed between said external power voltage detecting circuit and said power voltage switching circuit, said switching signal setting circuit setting the power voltage switching signals so that the output of said power voltage switching circuit is the internal power supply when power is first applied to the semiconductor apparatus.

2. The power circuit as claimed in claim 1 wherein the external power supply is connected to a source and a gate and said switching signal setting circuit includes:

a ground power supply;

a first capacitor provided between the output of said external power voltage detecting circuit and the external power voltage;

an inverter having the output of said external power voltage detecting circuit as an input and providing an output connected to a drain;

a second capacitor provided between the output of the inverter and the ground power supply; and a p type MOS transistor.

3. A power circuit for a semiconductor apparatus subject to an external power voltage, said power circuit comprising:

an internal power voltage generating circuit generating an internal power voltage;

an external power voltage detecting circuit outputting external power voltage detecting signals when said external power voltage reaches a threshold voltage;

a power voltage switching signal generating circuit receiving the external power voltage detecting signals and outputting a power voltage switching signal when the external power voltage detecting signals continue to be received for a threshold time; and a power voltage switching circuit switching the internal power voltage to the external power voltage in response to the power voltage switching signal.

4. The power circuit as claimed in claim 3 wherein said power voltage switching signal generating circuit includes:

a ground power voltage;

a CMOS type of inverter receiving as input the external power voltage detecting signal and providing as output the power voltage switching signal, said inverter having an n type MOS transistor and a p type MOS transistor with the mutual conductance of the n type MOS transistor being larger than the mutual conductance of the p type MOS transistor; and a capacitor provided between the power voltage switching signal and the ground power voltage.

5. The power circuit as claimed in claim 3 wherein said power voltage switching signal generating circuit includes:

a delayer receiving the power voltage detecting signals and providing as output delayed power voltage detecting signals, and a NOR circuit receiving the power voltage detecting signals and the delayed power voltage detecting signals and providing as output the power voltage switching signals.

6. The power circuit as claimed in claim 2 wherein said inverter is a CMOS type of inverter having an n type MOS transistor and a p type MOS transistor with the mutual conductance of the n type MOS transistor being larger than the mutual conductance of the p type MOS transistor.

7. A power circuit for a semiconductor apparatus subject to an external power voltage, said power circuit comprising:

an internal power voltage generating circuit generating an internal power voltage;

an external power voltage detecting circuit having a detecting reference voltage generating circuit and an external power voltage discriminator, said detecting reference voltage generating circuit providing as output a reference voltage and said external power voltage discriminator receiving as input the reference voltage and providing an output signal for said external power voltage detecting circuit;

a power voltage switching circuit switching the internal power voltage to the external power voltage in response to the output signal of the external power voltage detecting circuit.

8. The power circuit as claimed in claim 7 wherein said internal power voltage generating circuit includes a supplier receiving as input the reference voltage from said detecting reference voltage generating circuit and providing as output said internal voltage.

* * * * *